United States Patent [19]

Fehling et al.

[11] 4,182,466

[45] Jan. 8, 1980

[54] WEAR PART FOR SLIDING GATES AND PROCESS FOR THE PRODUCTION OF SUCH WEAR PARTS AND SLIDING GATE WITH SUCH WEAR PARTS

[75] Inventors: Hans R. Fehling, Geneva, Switzerland; Horst Hase, Wiesbaden, Fed. Rep. of Germany

[73] Assignee: Didier-Werke AG, Wiesbaden, Fed. Rep. of Germany

[21] Appl. No.: 810,285

[22] Filed: Jun. 27, 1977

[30] Foreign Application Priority Data

Jun. 25, 1976 [GB] United Kingdom ..... 26648/76

[51] Int. Cl.[2] ..... B22D 41/08

[52] U.S. Cl. ..... 222/600; 106/64; 264/60; 264/268

[58] Field of Search ..... 222/600, 561, 591; 264/30, 60, 267, 268, 269; 106/64

[56] References Cited

U.S. PATENT DOCUMENTS

| | | | |
|---|---|---|---|
| 1,999,325 | 4/1935 | Borsari-Fischer | 428/489 X |
| 3,765,579 | 10/1973 | Cramer et al. | 222/600 |
| 3,841,539 | 10/1974 | Shapland, Jr. et al. | 222/600 |
| 3,923,531 | 12/1975 | Parsons et al. | 106/97 X |
| 3,970,283 | 7/1976 | Hind | 222/600 X |
| 3,995,086 | 11/1976 | Plunguian et al. | 428/539 X |

*Primary Examiner*—David A. Scherbel
*Attorney, Agent, or Firm*—Friedman, Goodman & Teitelbaum

[57] ABSTRACT

A wear part for sliding gates used for the outlet of vessels which contain metal melts therein, the wear part being for example a sliding plate, a base plate, an inlet tube or an outlet tube. The wear part includes a refractory material surrounded by a metal mantle, where a fireproof refractory concrete is poured into a mold and hardened therein so that the mold serves as the metal mantle when the concrete has hardened. A lining surrounding a through-bore in the wear part may be cast therewith. The wear part is preferably clamped in a supporting frame.

14 Claims, 3 Drawing Figures

WEAR PART FOR SLIDING GATES AND PROCESS FOR THE PRODUCTION OF SUCH WEAR PARTS AND SLIDING GATE WITH SUCH WEAR PARTS

The invention relates to a wear part of a sliding gate for the outlet of vessels containing metal melts, for example sliding plate, base plate, inlet tube or outlet tube, made of a refractory material surrounded by a metal mantle.

Refractory parts of this type are known. Where the prior art shows, for example, a sliding gate closure mechanism, in which the sliding plate and the heat plate are seated in metal housings, the surface part of the sliding plate which touches the heat plate being highly erosion-proof and fireproof.

A problem of the present invention is to propose a wear part of the type mentioned at the outset with high trueness to measure and stability, which can be produced with the desired tightness and reinforcement substantially more simply, i.e., in particular, free of mortar, than the known wear parts for sliding gates. The invention relates, further, to a process for the production of such wear parts, as well as to a sliding gate with such wear parts.

With the invention in the case of a wear part of a sliding gate for the outlet of vessels containing a metal melt this problem is solved in that it consists of refractory fire concrete poured into the metal mantle formed as a lost mold and hardened therein.

In contrast to the known parts, the wear part according to the invention can be produced in a single operation with high trueness to measure and without use of mortar, as the desired metal mantle itself serves as casting mold and thereby there arises at intimate bonding between metal and refractory concrete. The refractory wear parts of the type according to the invention are, therefore, extremely economical to produce and are of high quality. It is surprising that such wear parts satisfy the high requirements on coming in contact with a metal melt.

While the aforementioned parts, such as sliding plate, base plate, inlet tube or outlet tube can be equipped each individually with a metal mantle of its own as a lost mold, which is especially desirable when a charge nozzle is provided, it is, however, also possible for slide plate and outlet tube and/or base plate and inlet tube to be cast in common in a single-piece metal mantle as lost mold.

Especially in the case of a wear part with a through-bore, such as a sliding plate, it is expedient that into the refractory concrete there also be cast a lining surrounding the through-bore, for example, a wear-resisting lining. In this manner the production process can be simplified, since the passage lining remains in the wear part as part of the lost mold.

Since the wear part consisting of different materials, namely metal and refractory material, is subjected to high thermal stresses, it is expedient that the refractory concrete of the wear part be that which is disclosed in German unexamined patent specification OS No. 26 24 299, printed as a German Offenlegungsschriften publication on Dec. 9, 1976, and corresponds to U.S. patent application Ser. No. 714,196.

The process for the production of a wear part of a sliding gate for the outlet of vessels containing a metal melt, for example slide plate, base plate, inlet tube, outlet tube, which consists of a refractory material surrounded by a metal mantle consists according to the invention of pouring a refractory concrete into the metal mantle constructed as a lost mold and allowing it to harden.

There it is possible to cast sliding plates and outlet tube and/or base plate and inlet tube in a single-piece metal mantle as lost mold.

The invention solves the problem of the prior art by using a hydraulically setting high-alumina refractory concrete having a compressive strength when cold, measured on the dried crude product, of at least 400 kp/cm$^2$, rising to at least 700 kp/cm$^2$ after firing at 1400° C., and a dimensional stability at 1400° C. of at least$\pm$0.2% for parts subject to wear coming into contact with metal melts, more particularly for the slide-valve plate and/or base-plate of slide-valve closure members on containers containing steel melts.

The result is a considerable simplification in manufacture, particularly of pairs of plates for slide-valve closure means, since when concrete is poured into a mould it exactly follows the shape of the mould surfaces and, if the surfaces are smooth and clean, they produce, smooth, clean matching surfaces on the moulded member. Consequently, the sliding surfaces of slide-valve plates can be manufactured very accurately during the actual moulding operation, thus avoiding the need for lengthy mechanical after-treatment. In addition, the flow apertures can be formed during moulding, after which the plates can be taken out ready for use.

The high-alumina concrete having the aforementioned physical properties can be used to ensure that parts subject to wear manufactured therefrom are safe in operation, even when highly stressed by heat, chemical corrosion and erosion. Very advantageously, the refractory concrete is mixed with corundum and active alumina as aggregates and contains less than 15% alumina cement containing not more than 22% lime, a thinning agent being added if necessary, and the material comprising preferably at least 96% $Al_2O_3$, less than 3% CaO and less than 0.5% SiO. The high content of $Al_2O_3$ has an advantageous effect on the resistance of the concrete moulding to changes in temperature. The resistance to changes in temperatures is also advantageously influenced by the total porosity, which is between 23 and 27 vol.% of exclusively open pores, which e.g. are the most suitable for impregnation with tar.

In the case of the aggregates (corundum and active alumina), the alumina content is advantageously between 5 and 15%. According to another feature of the invention, it may be particularly advantageous, for certain applications, to replace 1 to 5% of the aggregates by a spinel-forming substance, preferably MgO or MgO-yielding compounds. At about 1000° C., the magnesia in the concrete reacts with the decomposition products from the dehydrated binder to form spinel, MgO, $Al_2O_3$. The concrete structure thus becomes stronger and denser and therefore also more resistant to the infiltration of steel melts and corrosion by slag, since the spinel has already formed when the slag appears in the steel bath. MgO can be replaced by NiO, CoO or ZnO or compounds yielding these oxides.

If required, the resistance of the moulding to slag can be further increased by adding up to 5% carbon black or graphite.

In many cases, it is advantageous to replace up to 7% of the aggregates by chromium oxide, so as to counteract the wetting of the moulding by liquid melts or slag.

Advantageously, the aggregates below 0.5 mm are present in the form of round grains, which also has an advantageous effect on the strength of the moulding.

The manufacture of a refractory part subject to wear will now be described with reference to a Table showing mixtures, particle sizes and properties of five refractory concretes according to the invention.

Concrete in accordance with items 1–5 was poured and vibrated in a mould corresponding in shape to a slide-valve plate. The subsequent setting and hardening lasted 12 hours. After release from the mould, the plate was left for 48 hours at room temperature and was then dried at 110° C., thus terminating the manufacturing process.

In order to test the strength at higher temperatures, the plate was first heat-treated at 600° C., then cooled, after which the compressive strength when cold was measured. The process was repeated at 1400° C.

The percentage contraction after firing at 1400° C., as given in the Table, is identical with the dimensional stability of the refractory concrete as required according to the invention.

The suitability of a refractory concrete for parts resistant to wear, more particularly for the pair of plates of slide-valve closure means, can also be judged from the Peeling test. This combines the following conditions:

An area about 30 mm in diameter on a plate measuring 100×100 mm with a smooth (ground) surface is heated with an oxyacetylene welding torch capable of burning through metal plates between 20 and 30 mm thick. The oxygen pressure is 2.5 atm. gauge and the acetylene-gas pressure is 0.5 atm. gauge. The distance of the plate from the burner nozzle, which is held by a stand, is 50 mm and the test lasts for 15 sec.

If no splintering occurs, the material is very suitable for manufacturing pairs of plates for slide-valve closure means. The material can be used if particles come loose, when the test-piece is subsequently scratched, but is useless if splintering occurs during the test.

| Example | | | 1 | 2 | 3 | 4 | 5 |
|---|---|---|---|---|---|---|---|
| Sintered corundum containing 99% $Al_2O_3$ | 3,15–6 | mm | 17,50 | 17,50 | 17,50 | 17,50 | 17,50 |
| | 1–3,15 | mm | 22,50 | 22,50 | 22,50 | 22,50 | 22,50 |
| | 0.5–1 | mm | 7,50 | 7,50 | 7,50 | 7,50 | 7,50 |
| | 0,09–0,5 | mm | 12,50 | 12,50 | 12,50 | 12,50 | 12,50 |
| | <0,09 | mm | 21,00 | 16,00 | 21,00 | 15,00 | 16,00 |
| Chromium oxide | <0,09 | mm | — | 5,00 | — | — | — |
| Active alumina | <0,09 | mm | 9,00 | 9,00 | 5,00 | 11,00 | 9,00 |
| Alumina cement containing 80% $Al_2O_3$ and 19% CaO | — | | 9,95 | 9,95 | 9,95 | 13,95 | 9,95 |
| Thinning agent (liquifying agent) for alumina cement (Polyelektrolyt) | — | | 0,05 | 0,05 | 0,05 | 0,05 | 0,05 |
| MgO | <0,09 | mm | — | — | 4,00 | — | — |
| Graphite powder | <0,09 | mm | — | — | — | — | 5,00 |
| | | | %100,00 | 100,00 | 100,00 | 100,00 | 100,00 |
| Added water (1/100 kg dry material) | | | 5,5 | 6,0 | 6,0 | 5,0 | 6,0 |
| Compressive strength when cold (kp/cm²) | | | | | | | |
| after drying at 110° C. | | | 1000 | 720 | 550 | 1200 | 630 |
| after heat treatment at 600° C. | | | 1000 | 720 | 660 | 1200 | 560* |
| after firing at 1400° C. | | | 1100 | 810 | 1200 | 1300 | 1060* |
| Total porosity after heat treatment at 600° C. (vol. - %) | | | 24 | 22 | 23 | 23 | 27* |
| Contraction after firing at 1400° C. (%) | | | + 0,1 | + 0,2 | − 0,1 | + 0,1 | + 0,1* |

*Reduced firing

In a particular embodiment of the process, in the casting of the refractory concrete into the metal mantle, there is poured along with it the lining, for example wear-resistant linings, surrounding the through-bore.

A sliding gate for the outlet of vessels containing metal melt, with wear parts, for example sliding plate, base plate, inlet tube or outlet tube, which consist of a refractory material surrounded by a metal mantle and are arranged in a carrying frame, is characterized with utilization of the thought of the invention, in that the wear parts consist of refractory fire concrete cast into the metal mantle formed as a lost mold and hardened in it and are clamped in the supporting frame. The special metal sheathing facilitates this clamping, so that also for the support of the wear parts, such as the sliding plate, no cementing is required on the carrying frame, and this makes possible a simple and rapid exchanging, for example, for usual-type fired ceramic plates; this is highly advantageous especially where different sliding plates are to be used, for example, in continuous casting, where magnesite plates are preferably used, and chill casting, where the concrete plates according to the invention are to be preferred.

Further features, advantages and possibilities of use of the present invention are yielded from the following description of an example of execution with the aid of the appended drawing. There, all the features described and/or represented by themselves or in any reasonable combination form the object of the present invention.

Figure 1:
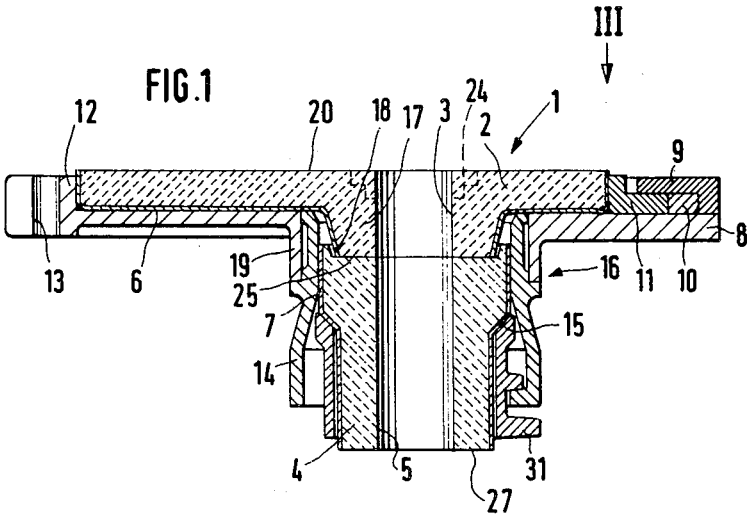
FIG. 1 shows schematically in section a sliding gate with wear parts according to the invention.

With the aid of the drawing, there will not be explained in detail, merely as wear parts of a sliding gate, two alternative forms of execution of a sliding plate as well as of an outlet tube. However, corresponding developments are directly yielded, of course, also for a base plate of a sliding gate and of an inlet tube, especially since the base plate and the sliding plate, and also the inlet tube and the outlet tube can be identical or at least very similar in form and material. Therefore, for simplicity, though only the sliding plate and the outlet tube are described below, the description and drawings also apply to the base plate and the inlet tube.

The sliding plate 1 has a sliding (or base) plate 2 which has a through-bore 3 and is clamped in a sliding frame 8. The sliding plate 2 has a spring part 17 surrounding the through-bore 3 and tapering downward from the flat part of the sliding plate 2. The sliding plate 2 is surrounded both on the outer edge and on the base surface of its flat part as well as on the outer edge of the spring part 17 with a metal mantle 6. There the sliding plate 2 is made in such a way that refractory concrete and metal mantle equal thermal expansion coefficients, being a specific heat expansion coefficient of 0.7 to 0.9% at 1000° C., preferably 0.8% at 1000° C. The upper sliding surface 20 of the sliding plate 2 and the downward-facing surface 25 of the spring (key) part 17 are exposed. The casting of the refractory concrete takes place expediently from the spring-side opening of the mold defined by the metal mantle 6. In the casting the through-bore 3 is kept free by a core. It is indicated in broken lines that in the pouring out of the sliding plate 2 at the inlet side end of the through-bore 3 there can be cast along with it a wear-resistant liner 24.

The sliding (or base) plate 2 is clamped in the sliding frame 8 by the means that a wedge member 10, which is held under a projection 9 of the frame 8, presses, on being driven in, a pressure piece 11 adapted to the transverse rounding of the sliding plate 2 and partly engaging this, against the edge of the sliding plate 2 and clamps the sliding plate 2 with the aid of the oppositely situated support 12 of the frame 8. Adjacent to the support 12 the frame 8 has an opening 13 for the engagement of the sliding gate rod (not shown). Thus, as best shown in FIG. 1 the pressure piece 11 exerts a clamping-in force on the sliding plate 2 in a longitudinal direction of the sliding plate, and because of the rounded edge of the pressure piece 11 engaging the transverse rounding of the sliding plate 2 shown in FIG. 3, the pressure piece 11 also exerts a clamping-in force on the sliding plate 2 in a transverse direction of the sliding plate (which is perpendicular to the cross section shown in FIG. 1).

From the flat part of the sliding frame 8 there extends downward a shoulder 19 surrounding the spring (key) part 17 of the sliding plate 2. On the shoulder 19 by means of lock 16 there is releasably mounted a housing 14 in which there is held an outlet tube 4 (or an inlet tube 4 for the base plate 2) with a through-bore 5. For this purpose the outlet tube 4 has an outer surface 15 extending obliquely downward, which rests on a corresponding counter-surface of a sealing sleeve 31, which, in turn, is detachably held on the housing 14. The outlet tube 4, too, is surrounded with a metal mantle 7 constructed as a lost mold, i.e., also the outlet tube 4 was produced by pouring refractory concrete into the metal mantle 5 and hardening it. The metal mantle 7 covers only the circumferential surfaces 15, but the end areas facing upward and downward are exposed. At the upper end the outlet tube 4 has a recess 18 which was kept free in the casting of the outlet tube 4 like the through-bore 5 and into which there engages the sliding plate 2 with the spring part 17.

Figure 2:
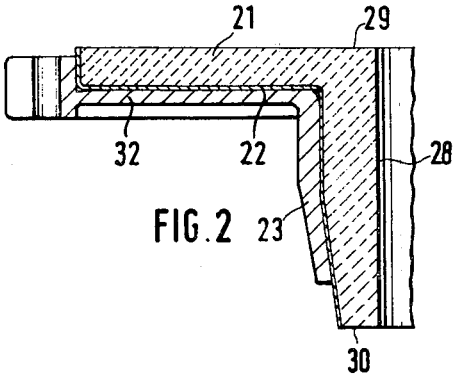
FIG. 2 shows schematically a partial section of a sliding gate with an alternative form of execution of a wear part according to the invention.

FIG. 2 illustrates a form of execution in which the sliding (or base) plate 21 is formed with the outlet (or inlet) tube in one piece, i.e., in comparison to FIG. 1, here spring part and outlet tube form a unit with uniformly continuous through bore 28. The sliding plate 21 is likewise made in such a way that the desired metal mantle 22 serves as a lost mold, in which the refractory fire concrete was poured and there hardened. The upper horizontal sliding surface 29 and the lower horizontal end surface 30 of the sliding plate 21 are free of the metal mantle 22. The part ending downward and forming the outlet tube of the sliding plate 21 tapers downward at its outer periphery. The downward-extending shoulder 23 of the sliding frame 32 has a corresponding bevel on its inside surface, so that the sliding plate 21 is held undisplaceably and, for example clamped as according to FIG. 3 in the sliding frame 8.

Figure 3:
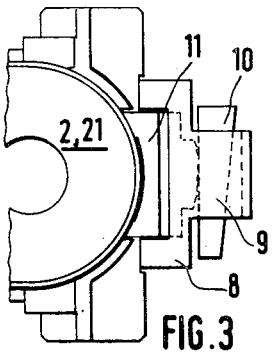
FIG. 3 shows a plan view (partially broken away) corresponding to III, FIG. 1.

FIG. 3 illustrates in plan view the clamping in of the sliding plate 2 or 21.

Preferably, each metal mantle 6, 7, and 22 contains a hydraulically setting high aluminiferous refractory concrete which has a cold pressure strength (measured on the dried raw product) of at least 400 kp/cm$^2$, which after firing at 1400° C. amounts to at least 700 kp/cm$^2$ and has a dimensional stability at 1400° C. of at least +0.2%.

What we claim is:

1. A wear part of a sliding gate defining an outlet of a vessel containing a metal melt, said wear part comprising any one of parts of said sliding gate coming into contact with the metal melt, said parts including a sliding plate, a base plate, an inflow tube and an outflow tube, said wear part being fabricated from a refractory material, sid refractory material being a fireproof refractory concrete, and metal means surrounding said refractory concrete in a bonding engagement therebetween and for serving as a casting mold for receiving said refractory concrete in a poured condition, said metal means being a metal mantle, whereby the poured refractory concrete hardens within said metal mantle to provide the bonded engagement therebetween, said refractory concrete and said metal mantle being retained as an integral unit to define said wear part.

2. A wear part according to claim 1, wherein said wear part includes one of said plates and one of said flow tubes, said one plate and said one flow tube being a one-piece cast refractory concrete member, said metal mantle having a one-piece body surrounding said one-piece cast refractory concrete member.

3. A wear part according to claim 2, wherein said one plate is said sliding plate and said one flow tube is said outflow tube.

4. A wear part according to claim 2, wherein said one plate is said base plate and said one inflow tube is said inflow tube.

5. A wear part according to claim 1, wherein said metal mantle and said refractory concrete have equal thermal expansion coefficients.

6. A wear part according to claim 1, wherein said refractory concrete is a hydraulically setting high aluminiferous refractory concrete having a cold pressure strength as measured on a dried raw product of at least 400 kp/cm$^2$, which after firing at 1400° C. amounts to at least 700 kp/cm$^2$, and having a dimensional stability at 1400° C. of at least ±0.2%.

7. A process for producing a wear part of a sliding gate defining an outlet of a vessel containing a metal melt, the wear part including any one of parts of the sliding gate coming into contact with the metal melt, the parts including a sliding plate, a base plate, an inflow tube and an outflow tube, said process comprising:

providing metal means for serving as a casting mold for receiving a refractory material;

providing the refractory material as a fireproof refractory concrete;

pouring said refractory concrete into said metal means;

allowing said refractory concrete to harden as a casting in said metal means to provide a bonded engagement therebetween with said metal means defining a metal mantle surrounding said refractory concrete; and retaining said refractory concrete and said metal mantle as an integral cast unit to define said wear part.

8. A process according to claim 7, including casting one of said plates and one of said flow tubes together to provide an integral wear part formed by a one-piece cast refractory concrete member surrounded by a one-piece metal mantle body.

9. A process according to claim 8, including casting a wear-resistant lining sleeve together with said one-piece cast refractory concrete member to surround a through-bore extending through said wear part.

10. A process according to claim 7, including casting a lining together with said refractory concrete to surround a through-bore extending through said wear part.

11. A process according to claim 7, including using a hydraulically setting high aluminiferous refractory concrete having a cold pressure strength when measured on a dried raw product of at least 400 kp/cm$^2$, which after firing at 1400° C. amounts to at least 700 kp/cm$^2$, and having a dimensional stability at 1400° C. of at least ±0.2%.

12. A sliding gate defining an outlet of a vessel containing a metal melt, said sliding gate comprising wear parts coming into contact with the metal melt, said wear parts including a sliding plate, a base plate, an inflow tube and an outflow tube, each of said wear parts being fabricated from a refractory material, said refractory material being a fireproof refractory concrete, metal means surrounding said refractory concrete of each of said wear parts in a bonded engagement therebetween and for serving as a casting mold for receiving said refractory concrete in a poured condition, said metal means being a metal mantle for each of said wear parts so that the poured refractory concrete hardens within said metal mantle to provide the bonded engagement therebetween, said refractory concrete and said metal mantle for each of said wear parts being retained as an integral unit to define each said wear part, and engaging means for clamping said wear parts in a supporting frame provided on the vessel.

13. A sliding gate according to claim 12, wherein said engaging means includes a key member for moving and holding a pressure piece member against said sliding plate to clamp said sliding plate in said supporting frame.

14. A sliding gate according to claim 13, wherein said pressure piece member has an arcuate surface engaging an arcuate surface of said sliding plate to exert clamping-in forces on said sliding plate in both longitudinal and transverse directions of said sliding plate.

* * * * *